US005169411A

United States Patent [19]

Weers

[11] Patent Number: 5,169,411

[45] Date of Patent: Dec. 8, 1992

[54] SUPPRESSION OF THE EVOLUTION OF HYDROGEN SULFIDE GASES FROM CRUDE OIL, PETROLEUM RESIDUA AND FUELS

[75] Inventor: Jerry J. Weers, Ballwin, Mo.

[73] Assignee: Petrolite Corporation, St. Louis, Mo.

[21] Appl. No.: 648,251

[22] Filed: Jan. 31, 1991

Related U.S. Application Data

[63] Continuation-in-part of Ser. No. 374,427, Jun. 30, 1989, abandoned, which is a continuation-in-part of Ser. No. 318,776, Mar. 3, 1989, abandoned.

[51] Int. Cl.[5] ..... C10L 1/22

[52] U.S. Cl. ..... 44/421; 44/420

[58] Field of Search ..... 44/420, 421

[56] References Cited

U.S. PATENT DOCUMENTS

| | | | |
|---|---|---|---|
| 2,055,810 | 9/1936 | Bartram | 44/420 |
| 2,701,187 | 2/1955 | Andress, Jr. | 44/420 |
| 4,778,609 | 10/1988 | Koch et al. | 252/47 |

FOREIGN PATENT DOCUMENTS

| | | | |
|---|---|---|---|
| 562825 | 9/1958 | Canada | 44/420 |

*Primary Examiner*—Ellen McAvoy
*Attorney, Agent, or Firm*—Kenneth Solomon

[57] ABSTRACT

Hydrogen sulfide gas evolution during storage or transport of petroleum residua is suppressed by the incorporation of an effective amount of certain imines.

47 Claims, No Drawings

SUPPRESSION OF THE EVOLUTION OF HYDROGEN SULFIDE GASES FROM CRUDE OIL, PETROLEUM RESIDUA AND FUELS

REFERENCE TO RELATED APPLICATIONS

This application is a continuation-in-part Application of U.S. patent application Ser. No. 374,427, filed Jun. 30, 1989 now abandoned; which is a continuation-in-part Application of U.S. patent application Ser. No. 318,776, filed Mar. 3, 1989, now abandoned.

FIELD OF THE INVENTION

The present invention relates generally to the field of crude oil, petroleum residua and fuels. More particularly, the invention relates to crude oil, petroleum residua and fuels containing sulfur compounds capable of forming hydrogen sulfide gases.

BACKGROUND OF THE INVENTION

A crude oil residuum or heavy oil which is often referred to as asphaltic fractions in the refining of crude oil is broadly understood to be the residue obtained from crude oil after a nondestructive distillation has removed substantially all of the volatile fractions. Refining temperatures are usually maintained below about 540° C. (1000° F.), and storage temperatures below about 350° C. (660° F.) as the rate of thermal decomposition of petroleum becomes substantial above such temperature. Residua are black, viscous materials and are obtained as a residue from atmospheric or vacuum distillation of a crude oil. They may be liquid at room temperature (generally atmospheric residua) or almost solid (generally vacuum residua) depending upon the crude oil.

The organic chemical composition of residua is complex and may contain ash-forming metallic constituents and sulfur compounds, since metals and sulfur compounds of one type or another are generally present in crude oil. In residua, there are many varieties of sulfur compounds depending on the prevailing conditions during the formation thereof. The presence of the sulfur compounds in the residua gives rise to the generation of a gas having substantial portions of hydrogen sulfide gas.

Residua have found extensive use as a bunker fuel oil, No. 6 fuel oil, fuel oil C, and marine fuel oil. Residua must be transported from the refinery to the points of use, such as a ship or a power generating plant. Unfortunately, during storage or such transport, hydrogen sulfide gases become liberated and give rise to a multitude of environmental problems.

Hydrogen sulfide is a very toxic gas and; thus, for safety purposes, the use of residua requires special handling. The contamination of residua with hydrogen sulfide forming substances thus presents a series of problems as the residua are stored or transported. Providing an effective chemical method for suppressing or inhibiting the liberation of hydrogen sulfide gases from residua is of considerable importance to the petroleum refining industry. Methods heretofore known for suppressing the liberation of hydrogen sulfide gases from residua suffer from the standpoint of effectiveness.

Hydrogen sulfide scavengers for use in other media are known. However, such scavengers are not recognized to have universal application and to be effective in widely differing media. For several reasons, the efficacy of such hydrogen sulfide scavengers is particularly problematic with respect to the media to which the present invention is directed (i.e., crude oil, petroleum residua and fuels). For example, as noted, petroleum residua are very complex and impure, containing a multitude of unknown compounds, providing ample opportunity for side reactions. The same, of course, is true for crude oil from which the residua are derived. Fuels, in particular mid-distillate fuels, such as kerosene and diesel fuels, while more refined, still contain a multitude of compositions. Accordingly, the scavenger must be very selective as well as fast acting. Moreover, the applications to which the media of the present invention are directed, for example, burning in engines, demand many other considerations, such as the ability to avoid the formation of residue.

Thus, for example, while compositions such as neutralizing amines, iron compounds and certain oxidizing compounds such as sodium hydroxide, are useful for suppression of hydrogen sulfide formation in cutting oils, they have been found to be unsuitable for use in the media of concern here. In particular, neutralizing amines have not been found to be thermally stable at temperatures to which such media are subjected. Iron compounds, upon combustion, form ash which is impermissible in applications such as use in turbine engines.

Certain types of oxidizers act by conversion of hydrogen sulfide to elemental sulfur. Because of the high reactivity of elemental sulfur, it tends to reform hydrogen sulfide in the media to which the present invention is directed. In addition, such oxidizers, examples of which include sodium hypochlorite and sodium nitrite, have deleterious affects on fuel and are dangerous to use. Other types of additives, such as sodium hydroxide, act as neutralizers, thereby forming end products, for example, sodium sulfide or sodium hydrogen sulfide, from the hydrogen sulfide. The insolubility and nonvolatility of such end products results in the formation of deposits in engines. In addition, sodium is known to cause corrosion at high temperatures, and has been found to react with the acid present in the impure media of concern herein, thus limiting its usefulness as a scavenger. Sodium hydroxide also has been found to have very limited efficacy in scavenging hydrogen sulfide in fuels. Thus, such oxidizers and neutralizers are not suitable for use in the media of the present invention. Various other oxidizers are not suitable for the media of concern herein because they react with a large number of the compounds present in the media.

U.S. Pat. No. 4,778,609 to Koch et al. describes the use of certain hindered monoimines to suppress the generation of hydrogen sulfide emissions in lubricating oil caused by the introduction of certain organic sulfides. However, such hindered monoimines are not as economical or commercially available as desired, nor is there any indication that such compositions (which are used by Koch et al. to treat relatively pure media in which side reactions are not of concern) would be sufficiently selective, fast-acting, and free of deleterious side effects to be useful in the difficult conditions associated with the complex media of concern in the present invention. In fact, especially in view of the statement at lines 46–55 of Column 2 of the Koch et al. patent that the scavengers disclosed therein successfully suppress hydrogen sulfide generation for only certain sulfur compounds, the Koch et al. patent contains no suggestion that the scavengers, which are used therein for certain organo-sulfur compounds added to the lubricating oil by Koch et al. would have any effectiveness at all with respect to the sulfur compound inherent in the media of concern herein.

Cole et al. U.S. Pat. No. 3,053,645 describes the use of certain condensation products of aldehyde and certain fatty diamines (having one primary amino group) in distillate fuel oils as stabilizers. These products are directed not to hydrogen sulfide scavenging, but to antioxidation. Stability and prevention of oxidation is of concern in distillate fuels, but not in crude oil or petroleum residua. In other words, whereas oxidation is not recognized as a problem in such unrefined media and treating such media would merely duplicate efforts because another treatment after refining would be required. Treatment of refined media is required to maintain product quality to avoid the necessity for reprocessing to render them suitable for use. Thus, the Cole et al. patent contains no teaching or suggestion of hydrogen sulfide scavenging in any media, or of treating crude oil or petroleum residua for any purpose.

Andress, Jr. et al. U.S. Pat. No. 3,449,424 is directed to certain acidic salicyladimines to inhibit corrosion, but contains no teaching or suggestion of any technique for inhibiting hydrogen sulfide generation. Thus, the Andress, Jr. et al. patent discloses the use of such compositions in media in which corrosion can be a problem (e.g., hydrocarbon fuels, lubricating oils and greases), as opposed to such generally aqueous-free media as crude oil or petroleum residua. Moreover, the acidic nature of such compositions renders them inapplicable for the media of concern in the present invention, where the acid reacts with amines and other various components present in the medium. Typically, compositions which contain acidic groups (e.g., phenolic or carboxylic groups) are employed as in Andress, Jr. et al. as corrosion inhibitors due to their ability to form a complex with iron and thereby to form a protective layer over iron surfaces. They do not act as scavengers.

Accordingly, there is still a need for economical, easily accessible, hydrogen sulfide scavengers that are sufficiently selective, fast-acting, non-residue producing and stable for use in crude oil, petroleum residua and fuels.

SUMMARY OF THE INVENTION

The present invention relates generally to crude oil, petroleum residua and petroleum fuel media containing hydrogen sulfide gas forming substances and to a method for chemically suppressing the liberation of the hydrogen sulfide gases from such media. The suppression or inhibiting of the generation of the hydrogen sulfide gases is accomplished by incorporating into the media at least one non-acidic imine compound which is the condensation product of an amine or polyamine and an aldehyde or ketone in an amount sufficient to inhibit hydrogen sulfide gas evolution.

By including an imine compound of the above general structure within residua in an amount of about 10 ppm to 10,000 ppm, it is possible to suppress satisfactorily the evolution of hydrogen sulfide gases which are normally generated during the storage and transfer of the residua. Preferably, the amount of imine added to the residua ranges from about 100 ppm to about 1,000 ppm.

DETAILED DESCRIPTION OF THE INVENTION

In accordance with the present invention, it has been discovered that the hindered monoimines of U.S. Pat. No. 4,778,609 (Koch et al.) are surprisingly effective, fast-acting and highly selective hydrogen sulfide scavengers in the inherently sulfur-containing and complex media of crude oils, petroleum residua and fuels and that such compositions do not form undesirable residues which interfere with the operation of such media in engines. Not only that, but such benefits have also been found for certain far more economical and commercially available imines (especially un-hindered polyimines), hindered polyimines and other hindered imines beyond the scope of U.S. Pat. No. 4,778,609.

More specifically, the hindered imines of the formula

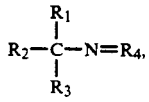

wherein $R_1$, $R_2$, $R_3$ and $R_4$ are independently selected alkyl moieties of from 1 to 14 carbon atoms (i.e., the imines disclosed in U.S. Patent No. 4,778,609) have been found to be so surprisingly selective and fast acting in complex crude oil, petroleum residua and fuels, and so free of deleterious activity during subsequent employment of the media in engines and other end uses that they are excellent hydrogen sulfide scavengers for such media. But such surprising results have also been found when compositions in which $R_1$, $R_2$, $R_3$ and $R_4$, for example, contain hetero constituents or are aromatics or in which up to two of $R_1$, $R_2$ and $R_3$ are hydrogen (i.e., when the compound is not hindered). Two of $R_1$, $R_2$ and $R_3$ may even be members of the same ring. In fact, it is believed that $R_1$, $R_2$ and $R_3$ may each be (if not hydrogen) any organic radical of up to eighteen or twenty carbon atoms and $R_4$ may be any organic radical of up to eight carbon atoms, provided only that the composition not contain sulfur groups (e.g., polysulfides) which tend to form more hydrogen sulfide in the media; that the compound be non-acidic (i.e., not a proton donor); and that when the media containing the compound is burned in an engine, the compound does not leave undesirable residue deposits. In addition, if the compound is to be used in mid-distillate petroleum fuels, it should be sufficiently soluble in the hydrocarbon medium that the desired concentration can be achieved. Moreover, related polyimine compositions, which are relatively readily available commercially, have been found to be often even more effective hydrogen sulfide scavengers in the media of concern herein.

The composition of the present invention is generally comprised of crude oil, petroleum residua or a petroleum fuel such as a mid-distillate (e.g., kerosene or diesel fuel) or a gas (e.g., methane or propane) and an effective amount of an imine (monoimine or polyimine) as above-described. The imine (monoimine or polyimine) is incorporated in residua after the residua are removed as a bottoms product from the refining of crude oil. The imine or polyimine should be thoroughly mixed in the medium. Thus, thorough incorporation of the imine in residua is accomplished preferably while the residua are at a temperature sufficiently high for the residua to have a suitable mixing viscosity but at a temperature sufficiently low to prevent thermal degradation of the additive. Often residua are too viscous at room temperature for the imine to be conveniently dispersed evenly throughout the residua. The incorporation of the additive to remove the hydrogen sulfide and thus to suppress the evolution of hydrogen sulfide gases should be made before the residua are stored or transported.

The imine compounds useful in the present invention can be prepared by reacting a suitable aldehyde, dialdehyde or ketone and a suitable primary amine or mixtures in a known and conventional manner. Thus, the imines can be obtained by reacting an amine with an aldehyde. The primary amine and the aldehyde are preferably combined in a primary amine group to aldehyde group mole ratio of about 1:1 (i.e., the stoichiometric amount for the formation of imine with substantially no side products).

The imines, including monoimines and polyimines, useful in the subject invention can be prepared under conventional dehydrating conditions, whereby water is removed by any suitable means. Typically, an aldehyde is added to the primary amine and the condensate recovered by mechanically separating as much of the water of reaction as possible and distilling off the remaining water. The reaction is generally exothermic and the exotherm should be controlled. The imines, whether monoimines or polyimines, can be formed from mixtures of different aldehydes, dialdehydes, or ketones and/or mixtures of different primary amines.

As used herein, the term "polyamine" refers simply to amines having more than one nitrogen atom. The amine should have from one to about ten, preferably one to about four, most preferably two to about four primary amine groups. Preferably, the amine contains at most about twenty carbon atoms, more preferably at most about eighteen carbon atoms. "Polyimines" are those imines having more than one N=C group. Preferably, the imine has from one to about ten N=C groups, more preferably two to about ten, even more preferably two to about four, especially two or three, and most preferably two.

Although a very wide variety of amines have been found to be suitable, if the resulting imine is to be used in petroleum fuels, it is preferred that the amine be such that the resulting imine be oil-soluble, meaning that the imine be soluble, or at least dispersible, in the fuel at least to the extent of achieving the concentration of imine desired for effectiveness at the temperature employed. It is also desired that the amine be such that the resulting imine be nether acidic nor leave a residue such as ash when the medium is burned. Thus, for example, an amino phenol or an amino acid would not be appropriate.

Preferred aldehydes may be aliphatic (e.g., formaldehyde) or aromatic (e.g., benzaldehyde) and have from one to about eight carbon atoms. The aldehyde should not be a phenol or other such aldehyde which would cause the resulting imine to be acidic.

It is understood that each N=C group is a functional site with respect to hydrogen sulfide scavenging. Considerations involved in selecting appropriate imines have been discussed above. Generally, organic radicals associated with the N=C functional groups are chosen for providing the imine with suitable oil-solubility if it is to be used for treating mid-distillate fuels, with relatively large radical groups of ten or more carbon atoms tending to impart greater solubility. On the other hand, however, the fact that larger radical groups tend to dilute the functionality of the N=C groups provides an upper limit on the size of the desired radicals. Further, the imine should be non-acidic (which means herein that it is not a proton donor), especially not strongly acidic. It has been found that acidic imines not only tend to be expensive, but typically exhibit relatively poorer hydrogen sulfide scavenging abilities and tend to initiate side reactions in the medium to be treated. Thus, phenols, carboxylic acids and in particular the acidic corrosion inhibitors of Andress, Jr. et al. U.S. Pat. No. 3,449,424, are not desirable.

Accordingly, although such a wide range of resulting imines have been found to be suitable that a sufficiently broad generic formula is difficult to provide, generally suitable imines may be represented by the following structural formula:

$$R_1(N{=}R_2)_x$$

wherein x is an integer of 1 to about 10; $R_1$ is independently selected from the group consisting of $$R_3O(CH_2)_n{-};\ R_5{-}\overset{\overset{R_4}{|}}{\underset{\underset{R_6}{|}}{C}}{-};$$

cycloalkyl having about 4 to about 7 carbon atoms; phenyl, benzyl;

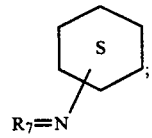

and alkyl having 1 to about 20 carbon atoms or alkenyl having 1 to about 20 carbon atoms; wherein $R_3$ is hydrogen, alkyl having 1 to about 20 carbon atoms, alkenyl having 1 to about 20 carbon atoms or aryl; n is an integer of 1 to 6; $R_4$, $R_5$, and $R_6$ are each independently selected from the group consisting of alkyl containing 1 to about 20 carbon atoms,

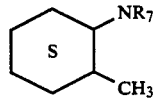

wherein $R_7$ is hydrogen, alkyl having 1 to about 20 carbon atoms, and $=R_2$ with the proviso that only one of $R_4$, $R_5$ and $R_6$ may be

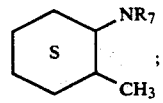

and wherein $R_2$ is independently selected from the group consisting of $CH_2$, cyclohexyl,

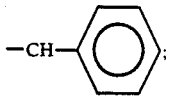

alkyl containing 1 to about 20 carbon atoms and alkenyl containing 1 to about 20 carbon atoms.

Thus, unhindered imines (imines in which the carbon singly bonded to the nitrogen of the N=C group is not part of a t-alkyl structure) as well as the generally less available and more expensive hindered imines (a t-alkyl group is bonded to the N=C nitrogen) have been found to be effective. Moreover, polyimines have been found to be even more effective than monoimines (for example, the monoimines of Cole et al. U.S. Pat. No. 3,053,645), particularly hindered monoimines, which are disclosed by Koch et al. in U.S. Pat. No. 4,778,609. Further, it has also been found that for the media of concern herein, the organic moieties attached to the N=C group are not limited to alkyl moieties or to fourteen carbon atoms as are the compositions Koch et al. apply to the lubricating oil and sulfurized organic compounds that are the concern of U.S. Pat. No. 4,778,609. In fact, organic moieties containing hetero constituents, for example, moieties such as ethanol, may be included in the imine compounds of the present invention.

As noted, the media to which such imine compounds are directed are crude oil, petroleum residua and fuels such as mid-distillates, for example, kerosene or diesel fuel, or gases like methane or propane. Thus, the additives have been found to be suitable for use in such fuels even despite the extreme conditions encountered by such fuels in use. Moreover, the additives have even been found to be suitable for use in crude oil and even petroleum residua even though such media not only encounter such demanding conditions but also include complex mixtures of compositions which have the potential of interfering with the additive activity or undergoing side reactions.

The amount of the imine, which may be a monoimine or polyimine, as herein defined effective to inhibit hydrogen sulfide gas liberation will vary, depending on various factors, for example, the particular residuum and conditions of storage and transport. In practice, at least an amount of about 10 ppm additive based on the weight of the residuum is used and preferably an amount of at least 100 ppm is used. Amounts of imine or polyimine exceeding 10,000 ppm can be employed; but, in general, there is usually no commercial or technical advantage in doing so.

Test Procedure

In the following examples, the effectiveness of the imine additives is determined by the following hydrogen sulfide gas evolution analysis. Into a metal container, the imine and 500 grams of sample residua are charged at ambient temperature. After capping the container, the container and contents therein are heated in a constant temperature bath for 60 minutes at 82° C. (180° F.). The container is then removed from the bath and shaken in a shaker for 30 seconds. Thereafter, the container and contents are again heated at 82° C. (180° F.) for another 30 minutes. Then the container and the contents are shaken again for 30 seconds. Immediately, after the second shaking, the cap is replaced with a one hole stopper. Connected to the stopper hole is a Dräger tube whose other end is connected to a Dräger gas detector pump. With one stroke of the pump, a gas sample is withdrawn through the tube. The tube is removed from the container. Thereafter, two strokes of pure air are brought through the tube allowing the absorbed hydrogen sulfide to convert quantitatively. The length of the discoloration in the tube blackened by $H_2S$ corresponds to the hydrogen sulfide concentration in the vapor above the liquid in the container. Alternatively, the headspace gas after the second shaking can be analyzed using a gas chromatograph connected to a mass spectrometer or other suitable device for quantitatively measuring $H_2S$.

In the following examples, all percentages are given on a weight basis unless otherwise indicated.

EXAMPLES 1-12

In the laboratory, various imines at various additive levels ranging from 100 ppm and 300 ppm were tested for their efficacy to suppress the liberation of hydrogen sulfide gas in different residua using the test procedure as above described. Residuum A employed in Tests 1-3 was bottoms from a fluid catalytic cracking unit. Residuum B employed in Tests 4-12 was a marine fuel oil blend. The results of such tests are summarized in the following table:

TABLE

| Test No. | Imine | Amount, ppm | $H_2S$ in Head Space, ppm | % $H_2S$ Reduction |
|---|---|---|---|---|
| 1. | Residuum A (no additive) | — | 889 | — |
| 2. | 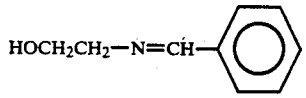 | 300 | 469 | 62 |
| 3. | 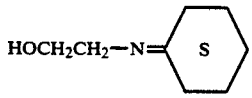 | 300 | 782 | 12 |
| 4. | Residuum B (no additive) | — | 1675 | — |
| 5. | 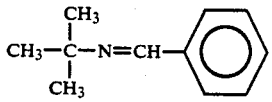 | 300<br>150 | <100<br><100 | 100<br>100 |

TABLE-continued

| Test No. | Imine | Amount, ppm | $H_2S$ in Head Space, ppm | % $H_2S$ Reduction |
|---|---|---|---|---|
| 6. | 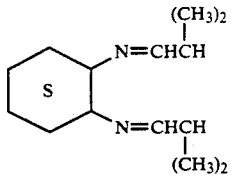 | 300 | <100 | 100 |
| 7. |  | 300<br>150 | <100<br>937 | 100<br>44 |
| 8. | 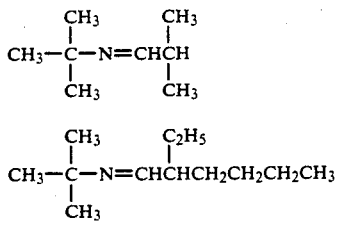 | 300<br>150 | <100<br><100 | 100<br>100 |
| 9. | 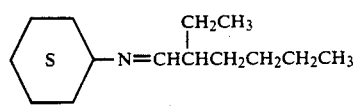 | 300<br>150 | 141<br>701 | 92<br>58 |
| 10.* | 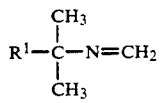 | 300<br>150 | 592<br>1526 | 65<br>8 |
| 11. | 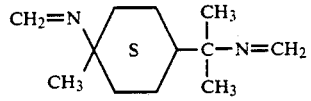 | 300<br>150 | 441<br>815 | 74<br>51 |
| 12. | 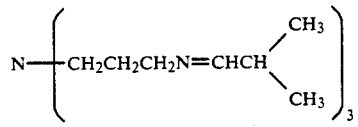 | 300<br>150 | <100<br><100 | 100<br>100 |

*$R^1$ in the compound of Test No. 10 was a branched $C_9$-$C_{14}$ alkyl radical.

The imine used in Test No. 2 was obtained by stirring one mole of ethanolamine dissolved in toluene at room temperature while one mole of benzaldehyde was added dropwise. The resulting mixture was stirred an additional one-half (½) hour and thereafter placed in a rotary evaporator heated at 80° C. under pressure of 20mm Hg to remove most of the water of reaction and to strip off the toluene. The imine product slowly precipitated as crystals.

The imine used in Test No. 3 was obtained by stirring one mole of ethanolamine dissolved in toluene at room temperature while one mole cyclohexanone was added dropwise. The resulting mixture was stirred an additional one-half (½) hour and thereafter placed in a rotary evaporator heated at 80° C. under a pressure of 20mm Hg to remove the water of reaction and to strip off the solvent. The resulting product was a clear colorless oil.

The imine used in Test No. 5 was obtained by stirring one mole of t-butylamine while one mole of benzaldehyde was added dropwise. The resulting mixture was stirred an additional one-half (½) hour and thereafter placed in a rotary evaporator heated at 80° C. under a pressure of 20 mm Hg to remove the water of reaction and unreacted reagents. The resulting product was a clear liquid having a boiling point of 222° C. at 760 mm Hg.

The imine used in Test 6 was obtained by stirring one mole of 1,2-diaminocyclohexane while one-half (½) mole of isobutyraldehyde was added dropwise. The resulting mixture was stirred an additional one-half (½) hour and thereafter placed in a rotary evaporate heated at 80° C under a pressure of 20 mm Hg to remove the water of reaction and unreacted reagents. The resulting product was a clear liquid having a boiling point of 120° C. at 20 mm Hg. This product was stirred and then an additional one-half (½) mole of isobutyraldehyde was added dropwise. The resulting mixture was stirred an additional one-half (½) hour and thereafter placed in a rotary evaporator heated at 80° C. under a pressure of 20 mm Hg. The resulting product was a colorless oil having a boiling point of 140° C. at 20 mm Hg.

The imine used in Test No. 7 was obtained by stirring one mole of t-butylamine while one mole of isobutyraldehyde was added dropwise. The resulting mixture was stirred an additional one-half (½) hour and thereafter placed in a rotary evaporator heated at 80° C. under a pressure of 20 mm Hg to remove the water of reaction and unreacted reagents The resulting product was a liquid having a boiling point of 125° C. at 760 mm Hg.

The imine used in Test No. 8 was obtained by stirring one mole of t-butylamine while one mole of 2-ethylhexanal was added dropwise. The resulting mixture was stirred an additional one-half (½) hour and thereafter placed in a rotary evaporator heated at 80° C. under a pressure of 20mm Hg to remove the water of reaction and unreacted reagents. The resulting product was a colorless liquid having a boiling point of 180°–185° C. at 760 mm Hg.

The imine used in Test No. 9 was obtained by stirring one mole of cyclohexamine while one mole of 2-ethylhexanal was stirred an additional one-half (½) hour and thereafter placed in a rotary evaporator heated at 80° under a pressure of 20 mm Hg to remove the water of reaction and unreacted reagents. The resulting product was a dark orange oil.

The imine in Test No. 10 was obtained by dissolving 100 grams of Primene 81R, a tertiary amine obtained from Rohm-Haas, Inc. and having the formula:

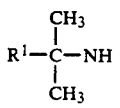

wherein $R^1$ is a branched $C_9$–$C_{14}$ alkyl radical and 41 grams of formalin (37% by weight aqueous solution of formaldehyde) in 25 grams of xylene. The resulting mixture was stirred and heated at 60° C for one hour and then transferred to a separator funnel. The aqueous layer was drawn off. The organic layer was washed twice using 25 ml of water during each washing. The organic layer was heated to distill off remaining water in the product and returning the xylene to the product. The resulting solution was a light yellow solution.

The imine used in Test No. 11 was prepared by stirring one mole of 1,8-diamino-p-menthane with two moles of formaldehyde (37% aqueous solution). Mixing was continued for two hours at 55° C. Then, 25 ml of dichloromethane was added and the resulting mixture was transferred to a separator funnel. The lower organic layer was removed. The solvent was stripped from the organic layer leaving a light orange oil.

The imine used in Test 12 was prepared by mixing one mole of tris(3-aminopropyl) amine and three moles of isobutyraldehyde in toluene and heating the mixture at reflux. Water of reaction was collected in a Dean-Stark trap. The product was then vacuum distilled and collected.

EXAMPLES 13–21

Additional imines and polyimines were prepared and tested for their efficacy in suppressing the evolution of hydrogen sulfide gases from petroleum residua.

In Test No. 13, one mole of 2,5-diaminohexane was stirred at room temperature while 2 moles of 2-ethylhexanal was added dropwise to the diaminohexane over a period of 30 minutes. After the aldehyde addition was completed, the water formed by the reaction was distilled off leaving the resulting polyimine, N,N'-2-ethylhexylidene-2,5-diaminohexane, as a high yellow colored product. 70 ppm of the polyimine was added to a residuum of a known $H_2S$ concentration. The percent reduction of the $H_2S$ in the head space using the above-described procedure was determined to be 69.

In Test No. 14, one mole of mixture of the 2,2,4 and 2,4,4 isomers of trimethylhexamethylene-1,6-diamine was stirred at room temperature while 2 moles of 2-ethylhexanal was added dropwise to the diamine over a period of 30 minutes. After the aldehyde addition was completed, the water formed by the reaction was distilled off leaving the resulting mixture of polyimine, N,N'-2-ethylhexylidene-2,2,4-trimethylhexamethylenediamine and N,N'-2-ethylhexylidene-2,4,4-trimethylhexamethylenediamine. This mixture was also effective in reducing $H_2S$ in residua.

In Test No. 15, one mole of Primene 81R amine, as used in Test No. 10 above, was stirred while 2 moles of 2-ethylhexanal was added dropwise to the amine over a period of 30 minutes. After the aldehyde addition was completed, the water formed by the reaction was distilled off leaving the resulting imine. 70 ppm of the imine was added to a residuum of a known $H_2S$ concentration. The percent reduction of the $H_2S$ in the head space using the above-described procedure was determined to be 71.

In Test No. 16, one mole of bishexamethylenetriamine and three moles of 2-ethylhexanal were dissolved in xylene. The reagent were refluxed for 4 hours. Water of reaction was collected in a Dean-Stark trap. When water ceased distilling, the reaction mixture was cooled to yield a dark colored oil which was identified as N,N'-dimethylhexylidene-bishexamethylenetriamine. 70 ppm of the polyimine was added to a residuum of a known $H_2S$ concentration. The percent reduction of the $H_2S$ in the head space using the above-described procedure was determined to be 65.

In Test No. 17, one mole of oleylamine obtained from Armak and one mole of formaldehyde were dissolved in xylene. The reagents were refluxed for one hour. Water of reaction was collected in a Dean-Stark trap. When water ceased distilling, the reaction mixture was cooled to leave an imine having a light yellow color. Upon storage at room temperature, the imine trimerizes to form a hexahydrotriazine which, under test conditions, reverts back to the imine. 70 ppm of the polyimine was added to a residuum of a known $H_2S$ concentration. The percent reduction of the $H_2S$ in the head space using the above-described procedure was determined to be 70.

In Test No. 18, one mole of 2-aminoethylpiperazine and two moles of 2-ethylhexanal were dissolved in xylene. The reagents were refluxed for one hour. Water of reaction was collected in a Dean-Stark trap. When water ceased distilling, the reaction mixture was cooled to leave a imine, N-2-ethylhexylidene-N'-2-ethylenehexylidene-2-aminoethylpiperazine, as a dark range colored oil. 70 ppm of the polyimine was added to the residuum of a known $H_2S$ concentration. The percent reduction of the $H_2S$ in the head space using the above-described procedure was determined to be 65.

In Test No. 19, one mole of glyoxal was added dropwise at room temperature to chloroform solvent containing two moles of n-butylamine. The resulting mixture was stirred for 45 minutes while being maintained at room temperature. The water layer was decanted from the mixture; and the solvent and remaining water were removed from the mixture by the use of a rotary evaporator heated at 80° C. under reduced pressure of 20 mm Hg to yield a light yellow oil. A proton NMR spectra confirmed that the diimine of the following chemical structure was obtained:

$$C_4H_9N{=}CH{-}CH{=}NC_4H_9$$

When 150 ppm and 300 ppm of the diimine prepared in accordance with Test No. 19 were added in separate tests to a residuum having a head space $H_2S$ concentration of 10,597 ppm as determined by the above-described test procedure, it was observed that the concentration of the head space $H_2S$ was reduced 33% and 71% in the respective tests.

In Test No. 20, one mole of cyclohexylamine was dissolved in chloroform. The resulting solution was heated to 60° C. and then 0.5 mole of glyoxal was added dropwise to the solution. During the aldehyde addition, a large amount of solid formed. After 30 minutes standing, the mixture was cooled and the solid was recovered by filtration. The collected solid was recrystallized from hexane to yield a white colored needle product. A proton NMR spectra confirmed the product was a diimine of the following chemical structure:

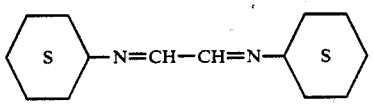

When 100 ppm and 300 ppm of the diimine prepared in accordance with Test No. 20 were added in separate tests to a residuum having a head space $H_2S$ concentration of 896 ppm as determined by the above described test procedure, it was observed that the concentration of the head space $H_2S$ was reduced 70% and 77% in the respective tests.

In Test No. 21, one mole of glyoxal was added dropwise at room temperature to chloroform solvent containing two moles of t-butylamine. The resulting mixture was then refluxed for one hour, cooled and left standing overnight. A large volume of light yellow crystals formed in the flask on standing. The crystals were filtered off and dissolved in hot hexane. The hexane was removed using a rotary evaporator heated at 80° C. under a pressure of 20 mm Hg to remove the water of reaction and to strip off the solvent to yield a light yellow solid. A proton NMR spectra confirmed that a diimine of the following chemical structure was obtained:

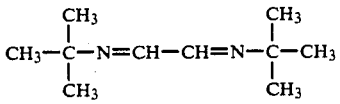

When 200 ppm of the prepared diimine was added to a residuum having a head space $H_2S$ concentration of 1216 ppm as determined by the above-described test procedure, it was observed that the concentration of the head space $H_2S$ in the headspace was reduced 95%.

As various changes can be made in the above described invention without departing from the scope of the invention, it is intended that the above description shall be interpreted as illustrative only and not in a limiting sense.

What is claimed is:

1. A process for treating a crude oil or petroleum residuum medium containing hydrogen sulfide to prevent liberation of the hydrogen sulfide from the medium during storage and transport, comprising adding to said medium an effective amount of a non-acidic imine compound which is the condensation product of an amine or polyamine and an aldehyde, dialdehyde or ketone thereby to inhibit liberation of the hydrogen sulfide from the medium during storage and transport.

2. The process of claim 1 wherein the medium is petroleum residuum.

3. The process of claim 1 wherein the imime compound is represented by the following structural formula:

$$R_1(N{=}R_2)_x$$

wherein x in an integer of 1 to about 10; $R_1$ is independently selected from the group consisting of

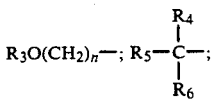

cycloalkyl having about 4 to about 7 carbon atoms; phenyl, benzyl;

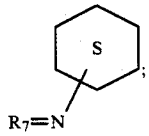

and alkyl having 1 to about 20 carbon atoms or alkenyl having 1 to about 20 carbon atoms; wherein $R_3$ is hydrogen, alkyl having 1 to about 20 carbon atoms, alkenyl having 1 to about 20 carbon atoms or aryl; n is an integer of 1 to 6; $R_4$, $R_5$, and $R_6$ are each independently selected from the group consisting of alkyl containing 1 to about 20 carbon atoms,

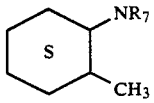

wherein $R_7$ is hydrogen, alkyl having 1 to about 20 carbon atoms, and $=R_2$ with the proviso that only one of $R_4$, $R_5$ and $R_6$ may be

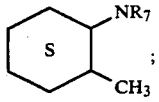

and wherein $R_2$ is independently selected from the group consisting of $=CH_2$, cyclohexyl,

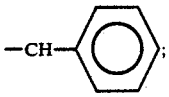

alkyl containing 1 to about 20 carbon atoms and alkenyl containing 1 to about 20 carbon atoms.

4. The process of claim 3 wherein the imine compound has the chemical structure of:

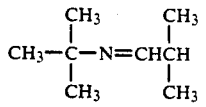

5. The process of claim 4 wherein the medium is crude oil or petroleum residuum.

6. The process of claim 3 wherein the imine compound has the chemical structure of:

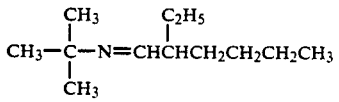

7. The process of claim 6 wherein the medium is crude oil or petroleum residuum.

8. The process of claim 3 wherein the imine compound has the chemical structure of:

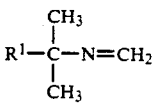

wherein $R^1$ is a straight or branched $C_9$–$C_{14}$ alkyl radical.

9. The process of claim 8 wherein the medium is crude oil or petroleum residuum.

10. A composition comprising a crude or petroleum residuum medium and a non-acidic imine compound which is the condensation product of an amine or polyamine and an aldehyde, dialdehyde or ketone in an amount sufficient to inhibition hydrogen sulfide evolution from the residua.

11. The composition of claim 10 wherein the imine additive is present in the amount of about 10 ppm to 10,000 ppm.

12. The composition of claim 10 wherein the imine additive is present in the amount of about 100 ppm to 1,000 ppm.

13. The composition of claim 10 wherein the imine additive has the chemical structure of:

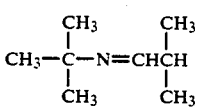

14. The composition of claim 10 wherein the imine additive has the chemical structure of:

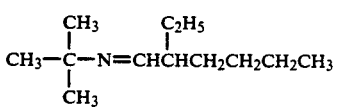

15. The composition of claim 10 wherein the imine additive has the chemical structure of:

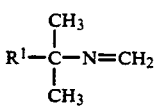

wherein $R^1$ is a straight or branched $C_9$–$C_{14}$ alkyl radical.

16. A composition comprising petroleum residua containing hydrogen sulfide and a sufficient amount of the following imine additive to inhibit evolution of the hydrogen sulfide as a gas from the residua:

$$R_1(N{=}R_2)_x$$

wherein x in an integer of 1 to about 10; $R_1$ is independently selected from the group consisting of

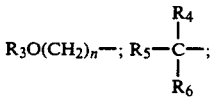

cycloalkyl having about 4 to about 7 carbon atoms; phenyl, benzyl;

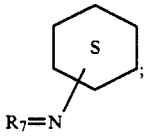

and alkyl having 1 to about 20 carbon atoms or alkenyl having 1 to about 20 carbon atoms; wherein $R_3$ is hydrogen, alkyl having 1 to about 20 carbon atoms, alkenyl having 1 to about 20 carbon atoms or aryl; n is an integer of 1 to 6; $R_4$, $R_5$, and $R_6$ are each independently selected from the group consisting of alkyl containing 1 to about 20 carbon atoms,

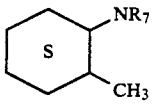

wherein $R_7$ is hydrogen, alkyl having 1 to about 20 carbon atoms, and $=R_2$ with the proviso that only one of $R_4$, $R_5$ and $R_6$ may be

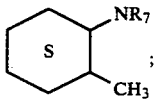

and wherein $R_2$ is independently selected from the group consisting of $=CH_2$, cyclohexyl,

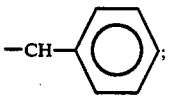

alkyl containing 1 to about 20 carbon atoms and alkenyl containing 1 to about 20 carbon atoms.

17. A process of inhibiting the liberation of hydrogen sulfide gas during storage or transport of a crude oil, petroleum residuum or petroleum fuel medium containing hydrogen sulfide, comprising adding to said medium an effective amount of a nonacidic imine compound which is the condensation product of an amine or a polyamine and an aldehyde, dialdehyde or ketone, the imine compound being selected from the group consisting of (1) unhindered imine compounds and (2) polyimine compounds.

18. The process of claim 17 wherein the imine compounds is an unhindered imine compound.

19. The process of claim 17 wherein the imine compound is a polyimine compound.

20. A process of inhibiting the liberation of hydrogen sulfide gas during storage or transport of the crude oil, petroleum residuum or petroleum fuel medium containing hydrogen sulfide, comprising adding to said medium an effective amount of a nonacidic imine compound which is the condensation product of an amine or a polyamine and an aldehyde, dialdehyde or ketone, the imine compound being selected from the group consisting of a compound of the structure

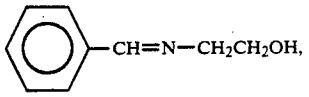

a compound of the structure

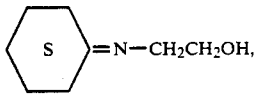

a compound of the structure

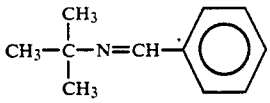

a compound of the structure

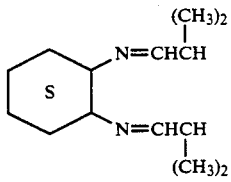

a compound of the structure

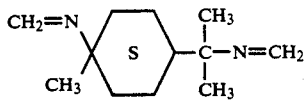

a compound of the structure

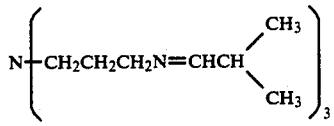

N,N'-2-ethyl-hexylidene-2,5-diaminohexane, a mixture of N,N'-2-ethylhexylidene-2,2,4-trimethylhexamethylenediamine and N,N'-2-ethylhexylidene-2,4,4-trimethylhexamethylenediamine, N,N'-dimethylhexylidene-vishexylmethylenetriamine, N-2-ethylhexylidene-N'-3-ethylenehexylidene-2-aminoethylpiperazine, a compound of the structure

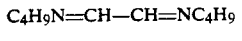

a compound of the structure

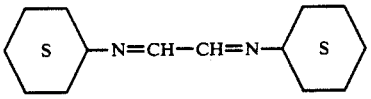

and a compound of the structure

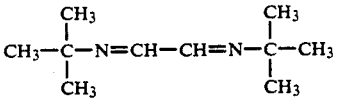

21. The process of claim 20 wherein the imine compound has the chemical structure of:

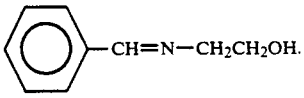

22. The process of claim 20 wherein the imine compound has the chemical structure of:

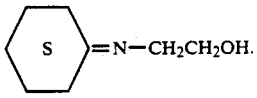

23. The process of claim 20 wherein the imine compound has the chemical structure of:

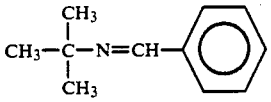

24. The process of claim 20 wherein the imine compound has the chemical structure of:

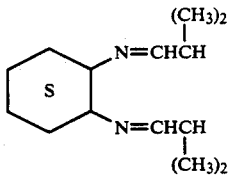

25. The process of claim 20 wherein the imine compound has the chemical structure of

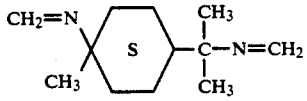

26. The process of claim 20 wherein the imine compound has the chemical structure of

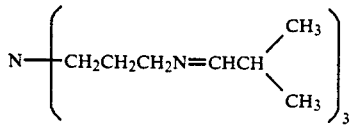

27. The process of claim 20 wherein the imine compound is N,N'-2-ethyl-hexylidene-2,5-diaminohexane.

28. The process of claim 20 wherein the imine compound is a mixture of N,N'-2-ethylhexylidene-2,2,4-trimethylhexamethylenediamine and N,N'-2-ethylhexylidene-2,4,4-trimethylhexamethylenediamine.

29. The process of claim 20 wherein the imine compound is N,N'-dimethylhexylidene-bishexamethylenetriamine.

30. The process of claim 20 wherein the imine compound is N-2-ethylhexylidene-N'-3-ethylenehexylidene-2-aminoethylpiperazine.

31. The process of claim 20 wherein the imine compound has the chemical structure of $C_4H_9N{=}CH{-}CH{=}NC_4H_9$.

32. The process of claim 20 wherein the imine compound has the chemical structure of

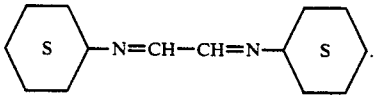

33. The process of claim 20 wherein the imine compound has the chemical structure of

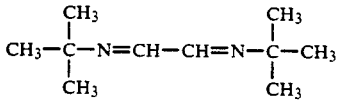

34. A composition comprising petroleum residua and a sufficient amount of an imine additive to inhibit hydrogen sulfide gas evolution, the amine additive being selected from the group consisting of

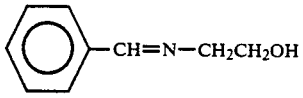

a compound of the structure

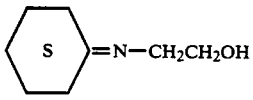

a compound of the structure

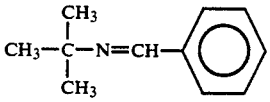

a compound of the structure

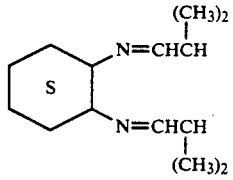

a compound of the structure

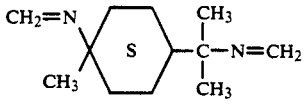

a compound of the structure

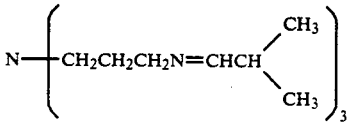

N,N'-2-ethyl-hexylidene-2,5-diaminohexane,N,N'-2-ethylhexylidene-2,2,4-trimethylhexamethylenediamine and N,N'-2-ethylhexylidene-2,4,4-trimethylhexamethylenediamine, N,N'-dimethylhexylidene-bishexamethylenetriamine, N-2-ethylhexylidene-N'-3-ethylenehexylidene-2-aminoethylpiperazine, a compound of the structure $C_4H_9N{=}CH{-}CH{=}NC_4H_9$ a compound of the structure

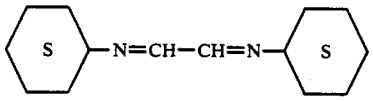

a compound of the structure

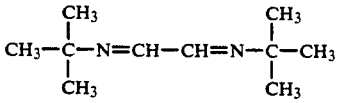

35. The composition of claim 34 wherein the imine additive has the chemical structure of:

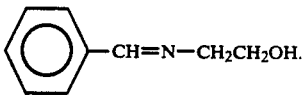

36. The composition of claim 34 wherein the imine additive has the chemical structure of:

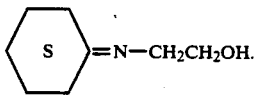

37. The composition of claim 34 wherein the imine additive has the chemical structure of:

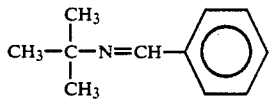

38. The composition of claim 34 wherein the imine additive has the chemical structure of:

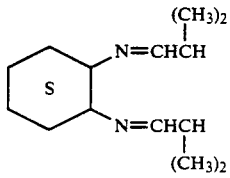

39. The composition of claim 34 wherein the imine additive has the chemical structure of

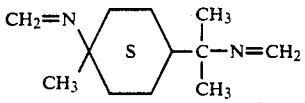

40. The composition of claim 34 wherein the imine additive has the chemical structure of

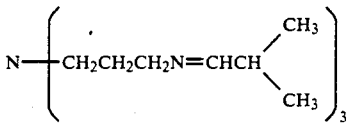

41. The composition of claim 34 wherein the imine additive is N,N'-2-ethyl-hexylidene-2,5-diaminohexane.

42. The composition of claim 34 wherein the imine additive is a mixture of N,N'-2-ethylhexylidene-2,2,4-trimethylhexamethylenediamine and N,N'-2-ethylhexylidene-2,4,4-trimethylhexamethylenediamine.

43. The composition of claim 34 wherein the imine additive is N,N'-dimethylhexylidene-bishexamethylenetriamine.

44. The composition of claim 34 wherein the imine additive is N-2-ethylhexylidene-N'-3-ethylenehexylidene-2-aminoethylpiperazine.

45. The process of claim 34 wherein the imine additive has the chemical structure of $C_4H_9N{=}CH{-}CH{=}NC_4H_9$.

46. The process of claim 34 wherein the imine additive has the chemical structure of

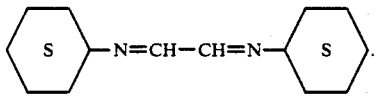

47. The process of claim 34 wherein the imine additive has the chemical structure of

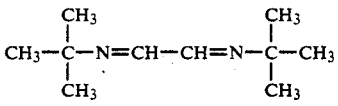

* * * * *